US005730102A

United States Patent [19]

Arnold et al.

[11] Patent Number: 5,730,102

[45] Date of Patent: Mar. 24, 1998

[54] ENGINE BRAKE DEVICE FOR A COMMERCIAL VEHICLE

[75] Inventors: Manfred Arnold, Aachen; Michael Schebitz, Eschweiler; Hermann-Josef Ecker, Vettweiss, all of Germany

[73] Assignee: FEV Motorentechnik GmbH & Co. Kommanditgesellschaft, Aachen, Germany

[21] Appl. No.: 624,500

[22] PCT Filed: Jul. 27, 1995

[86] PCT No.: PCT/EP95/02972

§ 371 Date: Aug. 2, 1996

§ 102(e) Date: Aug. 2, 1996

[87] PCT Pub. No.: WO96/05415

PCT Pub. Date: Feb. 22, 1996

[30] Foreign Application Priority Data

Aug. 8, 1994 [DE] Germany ..... 9412763 U

[51] Int. Cl.[6] ..... F01L 9/04; F01L 13/06

[52] U.S. Cl. ..... 123/322

[58] Field of Search ..... 123/322, 321, 123/90.11

[56] References Cited

U.S. PATENT DOCUMENTS

| | | | |
|---|---|---|---|
| 3,710,908 | 1/1973 | Muir | 477/90 |
| 4,762,095 | 8/1988 | Mezger et al. | 123/90.11 |
| 5,131,624 | 7/1992 | Kreuter et al. | 123/90.11 |
| 5,255,650 | 10/1993 | Faletti et al. | 123/322 |

FOREIGN PATENT DOCUMENTS

| | | |
|---|---|---|
| 0 320 536 | 6/1989 | European Pat. Off. . |
| 0 405 187 | 1/1991 | European Pat. Off. . |
| 0 405 189 | 1/1991 | European Pat. Off. . |

OTHER PUBLICATIONS

Patent Abstracts of Japan, vol. 14, No. 357 (M-1005), Aug. 2, 1990, for JP 2-125905 (Kawasaki) May 14, 1990.

*Primary Examiner*—Andrew M. Dolinar
*Attorney, Agent, or Firm*—Spencer & Frank

[57] ABSTRACT

An internal combustion engine includes an intake valve for controlling a cylinder intake port; an exhaust valve for controlling a cylinder exhaust port; first and second valve lifters coupled to the intake and exhaust valves, respectively, for cyclically opening and closing the intake and exhaust valves during normal engine operation; and an actuating device for contacting the exhaust valve and for operating the exhaust valve independently from the second valve lifter. The actuating device has a withdrawn position and a valve-contacting position. In the withdrawn position the actuating device is out of contact with the exhaust valve and in the valve-contacting position the actuating device is in contact with the exhaust valve. There is further provided an electromagnetically-operating setting device having an inoperative position assumed for a normal engine operation and an operative position assumed for an engine-braking operation. The actuating device is coupled to the electromagnetically-operating setting device such that in the inoperative position of the electromagnetically-operating setting device the actuating device is in the withdrawn position and in the operative position of the electromagnetically-operating setting device the actuating device is in the valve-contacting position. The electromagnetically-operating setting device further has a mechanism for operating the actuating device to open and close the exhaust valve when the actuating device is in the valve-contacting position.

6 Claims, 3 Drawing Sheets

ENGINE BRAKE DEVICE FOR A COMMERCIAL VEHICLE

BACKGROUND OF THE INVENTION

In exhaust gas turbocharger engines used in commercial vehicles, the increasing level of charge decreases the braking performance related to useful effect. Contemporary systems often can no longer meet the legal requirements. Auxiliary systems, such as retarder brakes, are extremely costly. The braking performance made possible by the use of an exhaust gate is limited.

SUMMARY OF THE INVENTION

To further increase the engine braking performance, an engine braking device for an internal combustion engine, particularly for a diesel engine, is provided in accordance with the invention, the device having an actuatable blocking element in the exhaust gas line and an actuating means that respectively acts on at least one discharge valve of a cylinder and is in operational connection with an electromagnetically-operating setting device.

The provision of this device makes it possible to actuate the discharge valve at least once during the compression phase of the engine, in addition to the usual opening times of the discharge valve, in order to additionally influence the exhaust gate. This additional opening is effected at least shortly before the end of the compression phase, so the compressed cylinder contents are pushed out into the exhaust gas line blocked by the exhaust gate and, after the exhaust valve closes and the upper dead center is exceeded, are no longer available for retroactively affecting the piston. In addition, the discharge valve can be opened briefly, by way of the electromagnetic setting device, at the start of the compression stroke, so that the gas blocked in the exhaust gas line by the exhaust gate flows into the cylinder due to the overpressure, necessitating additional compression work that has a braking effect on the vehicle. The particular advantage of the engine braking device of the invention in comparison to conventional mechanically, hydraulically or pneumatically actuated braking devices of this type is that "individual actuation" is possible with the use of a corresponding control device. Thus, it is possible, for example, to create a stepped braking effect by way of this exhaust gas brake in that not all cylinders are affected when the braking process is initiated; only one or a few of the cylinders is or are initially actuated. An opening and closing of the discharge valves that is optimal with respect to the braking moment can be effected with this type of actuation, preferably electronic actuation, of the individual electromagnetically-operating setting units as a function of rpm during the compression stroke in braking operation.

A further advantage of the engine braking device of the invention lies in the reduction of components compared to conventional braking systems; as a result, the electromagnetically-operating setting device can be disposed in the cylinder head of the engine, for example laterally next to or above the valves.

In an advantageous embodiment of the invention, it is provided that the electromagnetic setting device is formed by a setting block in which an armature is guided which is in operational connection with the actuating means, the armature also being connected to two spring elements acting counter to one another, the armature further being allocated at least one magnetic coil as an opening element and at least one magnetic coil as a closing element. To activate the setting unit, the armature is brought into the closing position by the closing magnet. The setting unit is subsequently brought into engagement with the aid of the magnetic coil, by way of the valve lifter, or the lower spring is prestressed with the aid of the additional coil and the prestressing armature. To open the valve, the prestressing magnet is shut off, so that the armature moves to the oppositely-located opening magnet and is taken over by this magnet. The impact speed of the armature against the opening magnet is determined by the other spring and by the characteristic of the current path of the opening magnet, by means of which the armature is held during the short opening phase of the discharge valve. The valve is closed by the shutoff of the opening magnet and simultaneous activation of the closing magnet.

This system permits activation of the setting device through the stimulation of armature oscillation at the natural system frequency and subsequent holding of the armature by the closing magnet, with simultaneous prestressing of the spring, and overall lifting of the setting block by the setting means, for example an additional magnet, thus effecting the contact of the actuating means with the tappet (shaft) of the discharge valve. The advantage of this combination is that, in the shut-off, currentless state, the discharge valve can operate freely in a normal operating cycle, and its function is not impaired by contact with the actuating means of the braking device, so even an incorrect setting of the work cycle of the actuating means has no effect on the discharge valve, and cannot lead to a reduction in engine performance during the compression phase and work phase of the relevant cylinder.

BRIEF DESCRIPTION OFT HE DRAWINGS

The invention is described in detail below in conjunction with schematic drawings of embodiments. Shown are in:

FIG. 1 a partial section through a cylinder head of an engine,

FIG. 2 a top view of a four-valve engine having a setting device,

FIG. 3 a section of a first embodiment of the setting means,

FIG. 4 a different arrangement of the electromagnetic setting means with respect to the actuating means, FIG. 5 another embodiment of the electromagnetic setting means.

DESCRIPTION OF THE PREFERRED EMBODIMENTS

Figure 1:
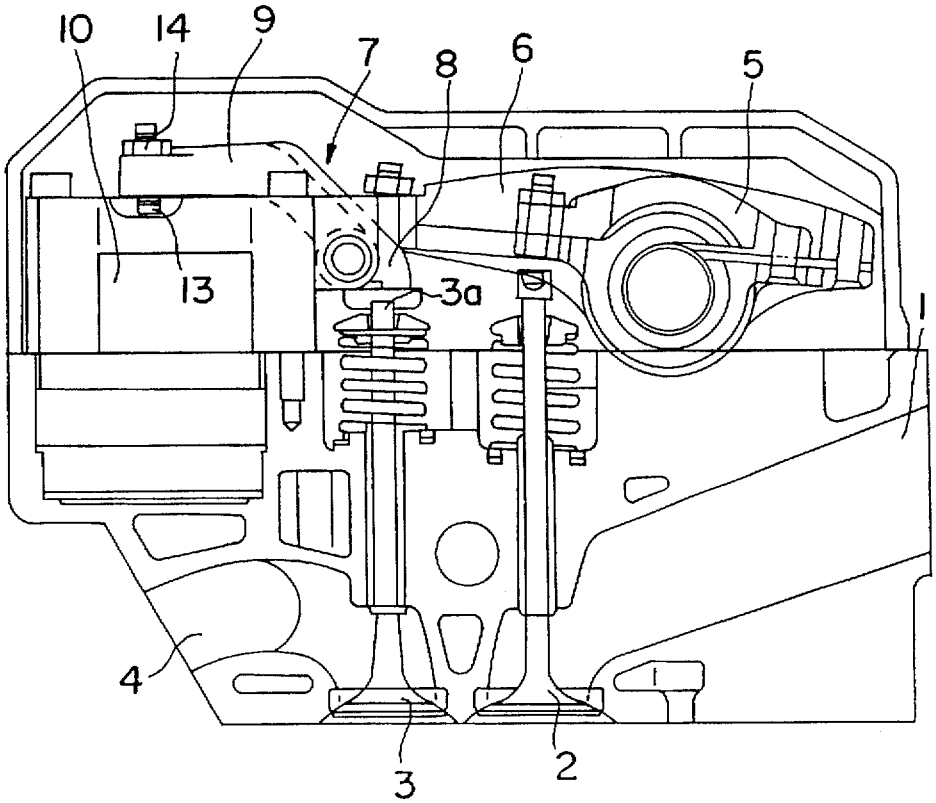

The section through the cylinder head of a diesel engine shown in FIG. 1 illustrates the intake conduit 1, the associated intake valve 2, the discharge (exhaust) valve 3 and the discharge conduit 4, which, together with the discharge conduits of the other cylinders, terminates in the exhaust gas line, in which an exhaust valve (gate or flap) is disposed as an actuatable blocking (shut-off) element. During normal operation, the intake valve 2 and the discharge valve 3 are actuated by way of the valve lifters 5 and 6.

An actuating means 7 in the form of a two-armed valve lifter is associated with the discharge valve 3, with the short arm 8 being associated with the shaft 3*a* of the discharge valve 3 to be actuated and the long arm 9 being in operational connection with an electromagnetic setting device 10.

Figure 2:
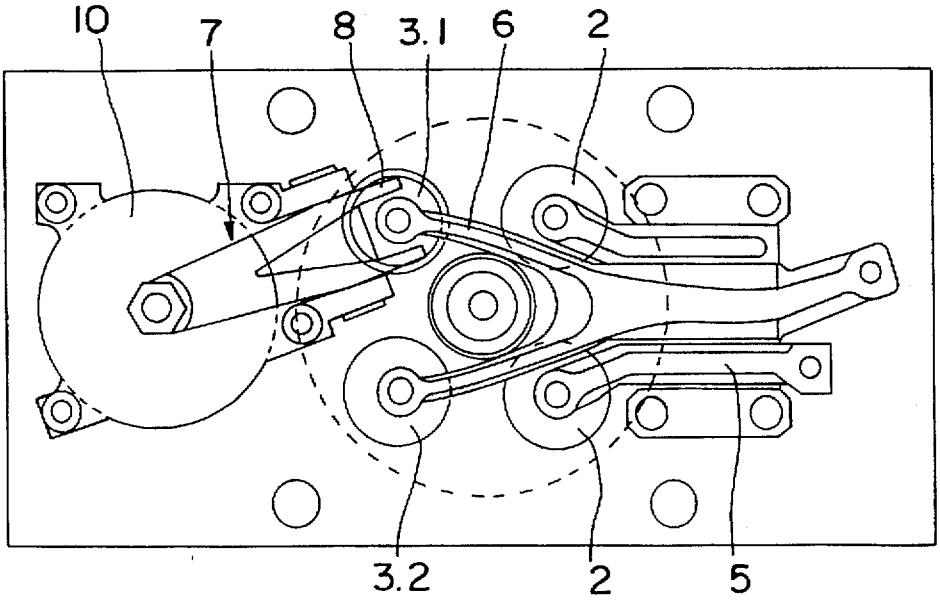

The top view according to FIG. 2, which is derived from FIG. 1, shows a possible arrangement for a four-valve engine having two intake valves 2 and two discharge valves 3.1 and 3.2. It can be seen from the top view that the actuating means 7 only acts on the discharge valve 3.1; the short arm 8 in this instance is forked, and extends around the free end of the associated arm of the valve lifter 6. Consequently, the discharge valve 3.1 can be actuated by way of the setting device 10, independently of the normal working rhythm, during the compression phase.

Figure 3:
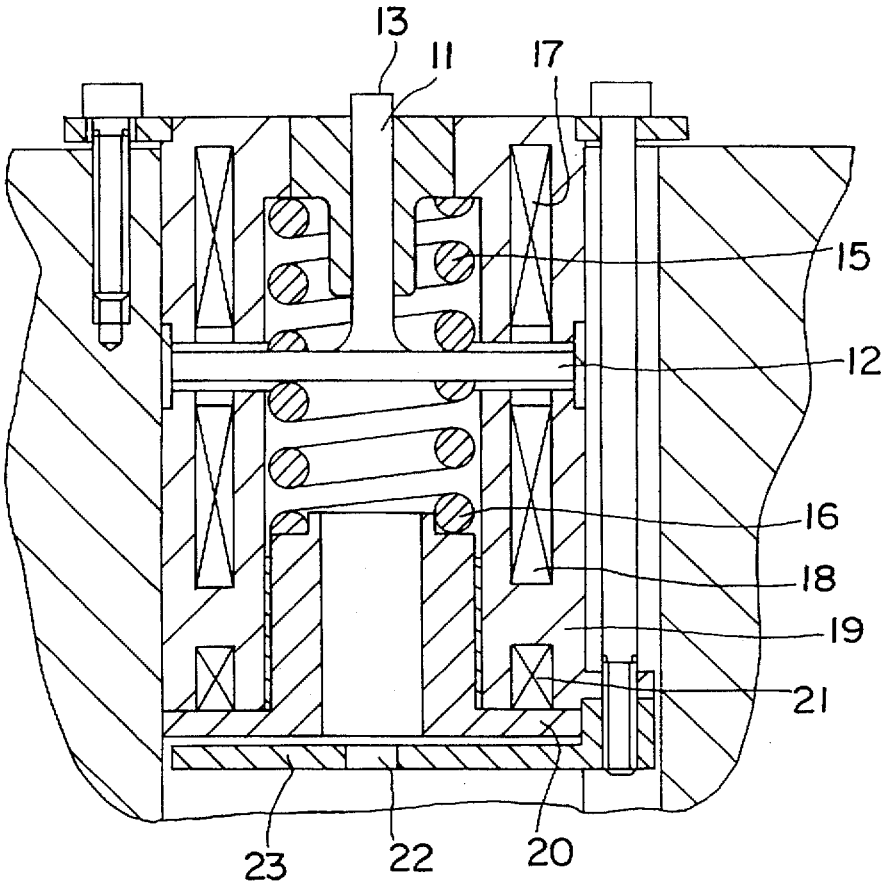

FIG. 3 shows a sectional view of a first embodiment for the electromagnetically-operating setting device 10. This device has a tappet 11 that is connected to an armature 12 and whose free end 13 rests against the end of the long arm 9 of the actuating means 7. The actuating means is typically provided in these regions with a setting screw 14 (FIG. 1), by way of which the work cycle can be set precisely. The actuating means 7 remains in contact with the tappet 11 by means of a restoring spring, not shown in detail here, that acts on the actuating means 7.

The armature 12 is connected to two springs 15 and 16, which act counter to one another and by means of which it is held in a predetermined central position. A magnetic coil 17 serving as an opening element on the side of the spring 15 is further associated with the armature 12, as is a magnetic coil 18 serving as a closing element on the side of the spring 16. To adhere to the oscillator principle, a prestressing armature 20 is associated with the setting block 19 that holds the springs 15 and 16 and the magnetic coils 17 and 18; this armature can be activated by an additional coil 21.

The necessary forces are made available by activating the magnet 18 and for prestressing the spring 16 by activating the magnet 21. In order to open the discharge valve 3 by way of the actuating means 7, the magnet 18 is shut off and the oppositely-located magnet 17 is turned on, so that the armature 12 comes into contact with the magnetic coil 17 in the end position of the armature, thereby opening the discharge valve 3. The impact speed of the armature against the magnet 17 is delayed by the spring 15.

The closing of the discharge valve 3 is effected by the shutoff of the magnet 17 and activation of the magnet 18.

The actuation of the individual magnets is effected by way of an electronic control as a function of rpm; this control only permits an opening of the discharge valve at predeterminable times during the compression phase, preferably at the beginning and end of the compression phase.

Figure 4:
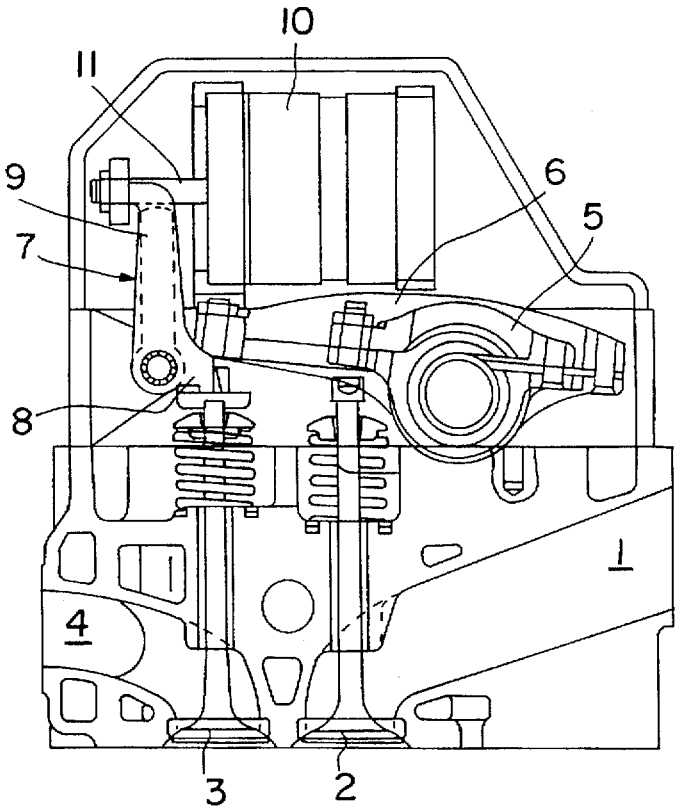

Whereas the arrangement according to FIG. 1 includes the electromagnetic setting device in an embodiment in which the tappet 11 operates as a pressure tappet, the embodiment illustrated in FIG. 4 is designed such that the tappet rod connected to the armature 12 acts as a towing bar. However, the design and function correspond to FIG. 3, the difference being that the association of the individual magnetic coils and the functional procedure is reversed with respect to the armature 12, or the arrangement is such that the tappet 11 is guided through the prestressing armature 20 and the opening 22 in the cover plate 23 of the setting block 19.

Figure 5:
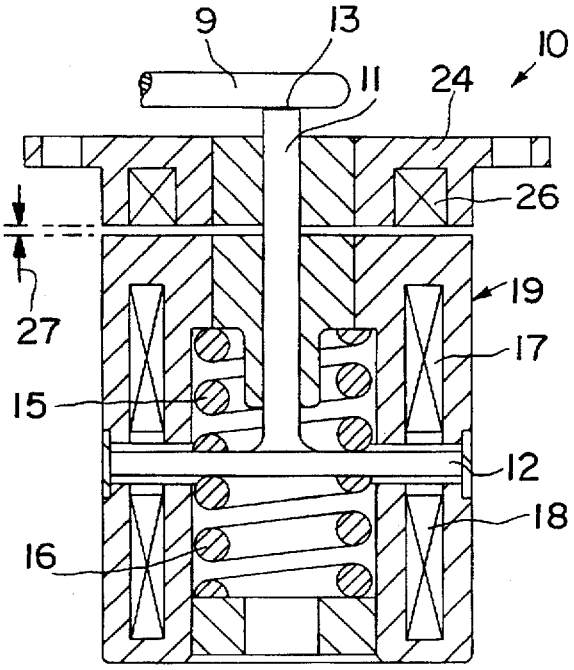

The embodiment shown in FIG. 5 is essentially configured like the embodiment according to FIG. 3, so the same reference numerals have been used for identical structural and functional elements. The additional prestressing coil 21 and the associated prestressing armature 20 are not included in this embodiment, but can be embodied in the same manner. The embodiment according to FIG. 5 differs from the embodiment according to FIG. 3 in that a base plate 24 is provided, in which a magnetic coil 26 is disposed. Because the actuating means 7 configured as a valve lifter utilizes its own restoring spring, the long arm 9 always rests against the free end 13 of the tappet 11. The air gap 27 between the base plate 24 and the end of the setting block 19 facing the base plate is dimensioned such that, in the currentless state, the short arm 8 of the actuating means 7 is not in contact with the discharge valve, so that the free tappet clearance is not impaired during normal operation. If the engine is to be driven with an engine brake, the magnet 26 is activated, so that the setting block 19 is lifted in its entirety from an inoperative position (shown in FIG. 5) to an operative position in which the air gap 27 disappears and the setting block 19 abuts the base plate 24. As a result, the actuating means 7 comes into contact with the discharge valve 3 without opening it, because the armature 12 is held by the closing coil 18. If the setting device 10 is activated by way of the electronic regulating device by an energization of coils 17, 18 as described in FIG. 3, so that the armature oscillates in the above-described manner, the discharge valve 3 can now open in the predetermined rhythm toward the end, but also at the beginning, of the compression phase of the associated cylinder.

We claim:

1. An internal combustion engine comprising (a) an intake valve for controlling a cylinder intake port;

(b) an exhaust valve for controlling a cylinder exhaust port;

(c) first and second valve lifters coupled to said intake and exhaust valves, respectively, for cyclically opening and closing said intake and exhaust valves during normal engine operation;

(d) an actuating device for contacting said exhaust valve and for operating said exhaust valve independently from said second valve lifter; said actuating device having a withdrawn position and a valve-contacting position; in said withdrawn position said actuating device being out of contact with said exhaust valve and in said valve-contacting position said actuating device being in contact with said exhaust valve; and (e) an electromagnetically-operating setting device having an inoperative position assumed for a normal engine operation and an operative position assumed for an engine-braking operation; said actuating device being coupled to said electromagnetically-operating setting device such that in said inoperative position of said electromagnetically-operating setting device said actuating device is in said withdrawn position and in said operative position of said electromagnetically-operating setting device said actuating device is in said valve-contacting position; said electromagnetically-operating setting device further comprising means for operating said actuating device to open and close said exhaust valve when said actuating device is in said valve-contacting position.

2. The internal combustion engine as defined in claim 1, wherein said actuating device comprises a pivotal lever having a first arm cooperating with said electromagnetically-operating setting device and a second arm cooperating with said exhaust valve; said first arm being longer than said second arm.

3. The internal combustion engine as defined in claim 2, wherein said second arm has a forked portion straddling an end portion of said second valve lifter.

4. An internal combustion engine comprising (a) an intake valve for controlling a cylinder intake port;

(b) an exhaust valve for controlling a cylinder exhaust port;

(c) first and second valve lifters coupled to said intake and exhaust valves, respectively, for cyclically opening and closing said intake and exhaust valves during normal engine operation;

(d) an actuating device for contacting said exhaust valve and for opening and closing said exhaust valve independently from said second valve lifter; said actuating device having a withdrawn position and a valve-contacting position; in said withdrawn position said actuating device being out of contact with said exhaust valve and in said valve-contacting position said actuating device being in contact with said exhaust valve; and (e) an electromagnetically-operating setting device comprising (1) a movable setting block having an inoperative position assumed for a normal engine operation and an operative position assumed for an engine-braking operation;

(2) an armature disposed in said setting block; said armature being displaceable relative to said setting block into a valve-opening and into a valve-closing position and further being arranged to move in unison with said setting block during displacements of said setting block; said armature being in contact with said actuating device;

(3) first electromagnetic means for moving said setting block between said inoperative and operative positions for moving said actuating device between said withdrawn and valve-contacting positions, respectively; and (4) second electromagnetic means for moving said armature relative to said setting block between said valve-opening and valve-closing positions when said setting block is in said operative position.

5. The internal combustion engine as defined in claim 4, wherein said first electromagnetic means comprises an electromagnet.

6. The internal combustion engine as defined in claim 4, wherein said second electromagnetic means comprises a first electromagnet moving, when energized, said armature into said valve-opening position and a second electromagnet moving, when energized, said armature into said valve-closing position.

* * * * *